US009164467B2

(12) United States Patent
Mori et al.

(10) Patent No.: US 9,164,467 B2
(45) Date of Patent: Oct. 20, 2015

(54) BLADE MEMBER AND CLEANING BLADE

(71) Applicant: SUMITOMO RIKO COMPANY LIMITED, Komaki-shi, Aichi (JP)

(72) Inventors: Hiroyuki Mori, Shizuoka (JP); Simpei Miyagawa, Shizuoka (JP); Yasunori Nimura, Aichi (JP); Katsumi Okashita, Aichi (JP); Shota Hayashi, Aichi (JP)

(73) Assignee: SUMITOMO RIKO COMPANY LIMITED, Aichi (JP)

( * ) Notice: Subject to any disclaimer, the term of this patent is extended or adjusted under 35 U.S.C. 154(b) by 0 days.

(21) Appl. No.: 14/693,130

(22) Filed: Apr. 22, 2015

(65) Prior Publication Data

US 2015/0227106 A1 Aug. 13, 2015

Related U.S. Application Data

(63) Continuation of application No. PCT/JP2014/072590, filed on Aug. 28, 2014.

(30) Foreign Application Priority Data

Aug. 29, 2013 (JP) ..... 2013-177680

(51) Int. Cl.
*G03G 21/10* (2006.01)
*G03G 21/00* (2006.01)

(52) U.S. Cl.
CPC ..... *G03G 21/0017* (2013.01)

(58) Field of Classification Search
CPC ..... G03G 21/0011; G03G 21/0017; C08G 18/10; C08G 18/12
USPC ..... 399/350
See application file for complete search history.

(56) References Cited

U.S. PATENT DOCUMENTS

| | | | | |
|---|---|---|---|---|
| 6,002,911 | A | 12/1999 | Suzuki et al. | |
| 8,224,224 | B2 * | 7/2012 | Ohmori et al. | 399/350 |
| 2002/0192430 | A1 | 12/2002 | Miura et al. | |
| 2009/0154971 | A1 | 6/2009 | Itoh et al. | |
| 2010/0316424 | A1 | 12/2010 | Sugimoto | |
| 2014/0323667 | A1 * | 10/2014 | Watabe et al. | 525/440.01 |

FOREIGN PATENT DOCUMENTS

| | | | |
|---|---|---|---|
| JP | 9-160457 | A | 6/1997 |
| JP | 11-212418 | A | 8/1999 |
| JP | 2002-296993 | A | 10/2002 |

(Continued)

OTHER PUBLICATIONS

International Search Report dated Dec. 2, 2014, issued in corresponding application No. PCT/JP2014/072590.

*Primary Examiner* — Sophia S Chen
(74) *Attorney, Agent, or Firm* — Westerman, Hattori, Daniels & Adrian, LLP

(57) ABSTRACT

A blade member 1 is used for removal of residual toner 5 remaining on a surface of a counterpart member 4 in an image forming device employing an electrophotographic system, by sliding contact with the counterpart member 4. The blade member 1 includes a blade body 11 made of a polyurethane rubber using diphenylmethane diisocyanate and a polyester polyol as main raw materials, and a film 12 that covers at least a surface of a sliding contact portion of the blade body 11 to contact with the counterpart member 4. The polyurethane rubber has an international rubber hardness degree of 65 to 85 IRHD, a tan δ peak temperature of 8° C. or lower, and a tan δ peak value of 1.1 or less. The film 12 contains a hydrocarbon polymer as a main component.

18 Claims, 3 Drawing Sheets

(56) References Cited

FOREIGN PATENT DOCUMENTS

| | | | |
|---|---|---|---|
| JP | 2003-103686 | A | 4/2003 |
| JP | 2007-65359 | A | 3/2007 |
| JP | 2007-79503 | A | 3/2007 |
| JP | 2007-133083 | A | 5/2007 |
| JP | 2007-322928 | A | 12/2007 |
| JP | 2008-250311 | A | 10/2008 |
| JP | 2009-186928 | A | 8/2009 |
| JP | 2012-58359 | A | 3/2012 |
| JP | 2013-83723 | A | 5/2013 |

* cited by examiner

BLADE MEMBER AND CLEANING BLADE

TECHNICAL FIELD

The present invention relates to a blade member and a cleaning blade.

BACKGROUND ART

In a conventional image forming device employing an electrophotographic system, a cleaning blade including a blade member has been disposed around a photoreceptor, the blade member has been in sliding contact with the photoreceptor, and residual toner remaining on the surface of the photoreceptor is removed by scraping off. For the material of the blade member, a flexible and relatively inexpensive polyurethane rubber is generally used. The cleaning blade generally has various functions for a reduction in frictional force with the photoreceptor.

For example, Patent Document 1 discloses a blade for an electrophotographic device, in which a flexible diamond-like carbon film (hereinafter, sometimes referred to as "FDLC film") is formed on a contact portion of an elastomer made of a polyurethane rubber, with a counterpart member, by the plasma CVD method.

PRIOR ART DOCUMENT

Patent Document

Patent Document 1: JP-A-2003-103686

SUMMARY OF THE INVENTION

Problem to be Solved by the Invention

The conventional blade member, however, has room for improvement in the following respects. That is, the blade member for use in the image forming device of the electrophotographic system is used while being in sliding contact with the counterpart member, and therefore is demanded for being good in durability, for example, having wear resistance. In addition, the blade member is demanded for being stably in sliding contact with the counterpart member such as the photoreceptor over a wide operating temperature range from a low temperature of about 0° C. to a high temperature of about 40° C., to remove residual toner. When the material and the hardness of a polyurethane rubber to be applied to the blade member are not suitable, however, the blade member is worn, the contact force with the counterpart member decreases, or degradation occurs. Accordingly, toner slips through between the blade member and the counterpart member. Also when the viscoelastic properties of the polyurethane rubber forming the blade member are not suitable, a viscoelastic behavior is significantly varied in an operating temperature range to cause slip-through of toner to occur.

A polyurethane rubber has a high dynamic friction coefficient. Therefore, in a blade member made of a polyurethane rubber, curling up easily occurs at the initial stage of sliding contact with the counterpart member (hereinafter, referred to as "initial curling up"). In particular, the initial curling up easily occurs in a high temperature range. If the initial curling up occurs, the subsequent removal of residual toner is difficult. When a carbon film such as a DLC film is formed on the surface of the blade member made of a polyurethane rubber, the hardness of the film is so high that followability to the counterpart member is deteriorated, and slip-through of toner is likely to occur in a low temperature range.

The present invention has been made in view of the above background, and has been made so as to provide a blade member that has durability and that allows initial curling up and slip-through of toner to be suppressed in a wide operating temperature range from a low temperature to a high temperature to thereby have good toner cleanability.

Means for Solving the Problem

One aspect of the present invention resides in a blade member to be used for removal of residual toner remaining on a surface of a counterpart member in an image forming device employing an electrophotographic system, by sliding contact with the counterpart member, the blade member including:

a blade body made of a polyurethane rubber using diphenylmethane diisocyanate and a polyester polyol as main raw materials; and a film that covers at least a surface of a sliding contact portion of the blade body to contact with the counterpart member, wherein the polyurethane rubber has an international rubber hardness degree of 65 to 85 IRHD, a tan δ peak temperature of 8° C. or lower, and a tan δ peak value of 1.1 or less, the film contains a hydrocarbon polymer as a main component, and a covering portion of the blade body provided with the film has an H1/H2 ratio of 2 or less, when a Martens hardness of a surface of the covering portion under a load of 0.1 mN is designated as H1, and a Martens hardness of a surface of the covering portion under a load of 1 mN is designated as H2.

削除

Another aspect of the present invention resides in a cleaning blade containing the blade member.

Effects of the Invention

The blade member includes the blade body made of the polyurethane rubber using diphenylmethane diisocyanate and the polyester polyol as main raw materials. Therefore, the blade member is hardy worn by sliding contact with the counterpart member, and has good durability. In addition, in the blade member, the polyurethane rubber forming the blade body has the international rubber hardness degree of 65 to 85 IRHD, the tan δ peak temperature of 8° C. or lower, and the tan δ peak value of 1.1 or less. In the blade member, the material, the hardness and the viscoelastic properties of the polyurethane rubber forming the blade body are suitable, so that wear, a decrease in the contact force with the counterpart member, the occurrence of degradation, and a large variation in viscoelastic behavior are suppressed, and slip-through of toner hardly occurs between the blade member and the counterpart member over a wide operating temperature range from a low temperature to a high temperature.

The blade member also includes the film containing the hydrocarbon polymer as the main component on the surface of the sliding contact portion of the blade body with the counterpart member. Therefore, in the blade member, the friction reduction effect of the film can result in a sufficient reduction in friction of the surface of the sliding contact portion, effectively suppressing initial curling up in a high temperature range. Moreover, the film is higher in flexibility than a carbon film such as a DLC film. Therefore, the blade member exhibits good followability to the counterpart member even in a low temperature range, and slip-through of toner hardly occurs.

A covering portion of the blade body provided with the film may have an H1/H2 ratio of 2 or less, when the Martens hardness of the surface of the covering portion under a load of 0.1 mN is designated as H1, and the Martens hardness of the surface of the covering portion under a load of 1 mN is designated as H2. Therefore, in the blade member, toner cleanability may be easily improved under a low temperature environment.

Accordingly, the blade member has durability and allows initial curling up and slip-through of toner to be suppressed in a wide operating temperature range from a low temperature to a high temperature, to thereby have good toner cleanability.

削除

The cleaning blade includes the blade member. Therefore, the cleaning blade has durability and allows initial curling up and slip-through of toner to be suppressed in a wide operating temperature range from a low temperature to a high temperature, to thereby have good toner cleanability. Therefore, the cleaning blade can suppress image defects due to toner cleaning failure in an image forming device over a long period.

MODE FOR CARRYING OUT THE INVENTION

Figure 1:
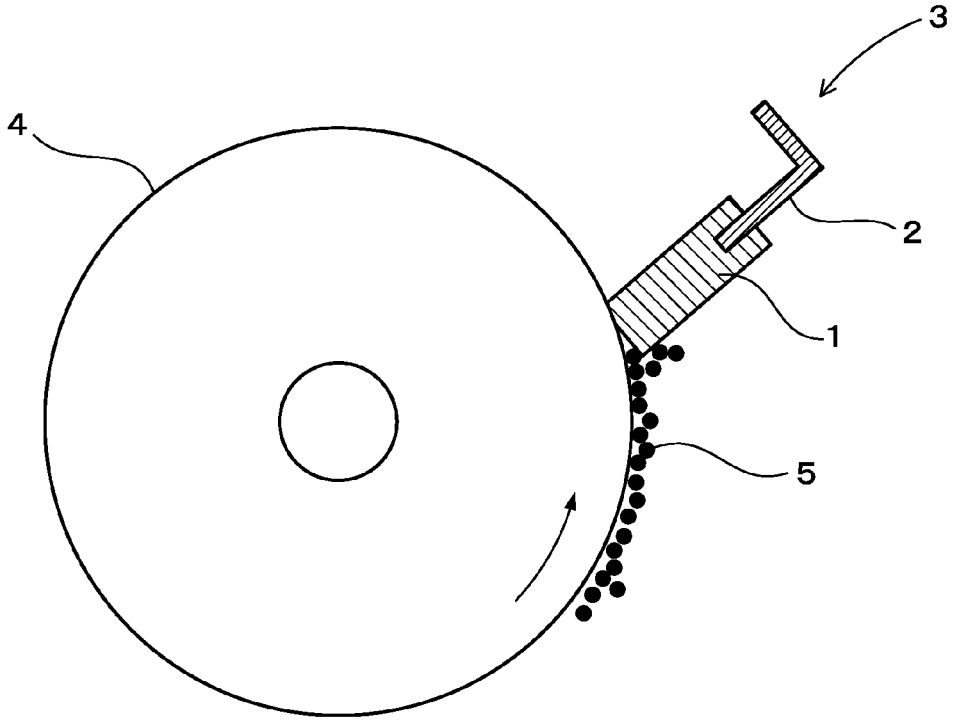
FIG. 1 is a view schematically illustrating use modes of a blade member of Example 1 and a cleaning blade of Example 2.

With respect to the blade member, examples of the image forming device can include a copier, a printer, a facsimile machine, a multifunction machine and a POD (Print On Demand) machine employing an electrophotographic system using a charged image. Examples of the counterpart member can include a photoreceptor and an intermediate transfer belt. The blade member, a part of which serves as the sliding contact portion to be brought into sliding contact with the counterpart member, can be in contact with the surface of an operating counterpart member in a sliding manner.

The blade member includes the blade body made of the polyurethane rubber using diphenylmethane diisocyanate (MDI) and the polyester polyol as main raw materials. Examples of other usable raw materials can include additives such as a chain extender, a crosslinking agent, a catalyst, a foaming agent, a surfactant, a flame retardant, a release agent, a filler, a plasticizer, a stabilizer and a colorant. The reasons why MDI is used as a main raw material of the polyurethane rubber are because a required wear resistance is easily ensured, handleability and availability are excellent, and the cost is low, for example. In addition, the reason why the polyester polyol is used as a main raw material of the polyurethane rubber is, for example, because the blade body can have an enhanced wear resistance to achieve good durability as compared with the case where an ether polyol is used as a main raw material.

Examples of the polyester polyol can include polybutylene adipate (PBA), polyethylene adipate (PEA), a copolymer of ethylene adipate and butylene adipate (PEA/BA), and polyhexylene adipate (PHA). These can be used singly or in combinations of two or more. Among them, polybutylene adipate is suitable because of allowing the blade body to have an enhanced wear resistance to achieve good durability, for example. In particular, a polybutylene adipate having a number average molecular weight in the range from 1000 to 3000, preferably 1500 to 2500, can be particularly suitably used because of allowing the tan δ peak temperature and the tan δ peak value of the polyurethane rubber to be easily set within the above ranges and of enhancing the moldability of the blade body to impart excellent productivity.

Examples of the chain extender can include bifunctional materials, for example, polyols having a number average molecular weight of 300 or less, such as 1,4-butanediol (1,4-BD), ethylene glycol (EG), 1,6-hexanediol (1,6-HD), diethylene glycol (DEG), propylene glycol (PG), dipropylene glycol (DPG), 1,4-cyclohexanediol, 1,4-cyclohexanedimethanol, xylene glycol and triethylene glycol. These can be used singly or in combinations of two or more. Among them, 1,4-butanediol (1,4-BD), ethylene glycol (EG), 1,6-hexanediol (1,6-HD) and the like are suitable from the viewpoint of allowing the international rubber hardness degree, the tan δ peak temperature and the tan δ peak value of the polyurethane rubber to be easily set within the above ranges.

Examples of the crosslinking agent can include tri- or higher functional materials such as trimethylolpropane (TMP), glycerin, pentaerythritol, sorbitol and 1,2,6-hexanetriol. These can be used singly or in combinations of two or more. Among them, trimethylolpropane (TMP) and the like are suitable from the viewpoint of allowing the international rubber hardness degree, the tan δ peak temperature and the tan δ peak value of the polyurethane rubber to be easily set within the above ranges.

Examples of the catalyst can include amine compounds such as a tertiary amine and organometallic compounds such as an organic tin compound. These can be used singly or in combinations of two or more.

In the blade member, the polyurethane rubber has an international rubber hardness degree in the range from 65 to 85 IRHD. Herein, the international rubber hardness degree corresponds to the value determined by subjecting a sample taken from a portion of the blade body, not having any film, to the international rubber hardness degree test method (M method) under measurement conditions of 25° C. and 50% RH by using a WALLACE micro-hardness tester manufactured by H.W. WALLACE according to JIS K 6253.

If the international rubber hardness degree is less than 65 IRHD, the wear resistance of the polyurethane rubber is deteriorated, the contact force with the counterpart member is decreased to easily cause slip-through of toner to occur, and toner cleanability is deteriorated. The international rubber hardness degree can be preferably 66 IRHD or more, more preferably 67 IRHD or more, further preferably 68 IRHD or more, further more preferably 69 IRHD or more, from the viewpoint of an enhancement in toner cleanability, for example. On the other hand, if the international rubber hardness degree is more than 85 IRHD, the polyurethane rubber is easily degraded to easily cause slip-through of toner to occur, and toner cleanability is deteriorated. In addition, the counterpart member is easily damaged by the polyurethane rubber having a high hardness. For example, such polyurethane rubber abrades the photoreceptor. The international rubber hardness degree can be preferably 84 IRHD or less, more preferably 83 IRHD or less, further preferably 82 IRHD or less, further more preferably 81 IRHD or less, from the viewpoint of an enhancement in toner cleanability, for example.

In the blade member, the polyurethane rubber has a tan δ peak temperature of 8° C. or lower and a tan δ peak value of 1.1 or less. Herein, the tan δ peak temperature and the tan δ peak value are determined as follows. A sample (1.6 mm×1.6 mm×30 mm) taken from a portion of the blade body, not having any film, is secured on a dynamic viscoelasticity measurement apparatus (DVE Rheospectoler manufactured by Rheology Co., Ltd.) so that the measurement length is 20 mm, and a sine wave strain of a displacement amplitude of ±10 μm and a frequency of 10 Hz is applied thereto and the tan δ (loss tangent) in the range from −20° C. to 50° C. is measured every 1° C. at a rate of temperature rise of 3° C./min. The temperature at which the resulting tan δ value is maximum (peak) is defined as the tan δ peak temperature, and the maximum tan δ value is defined as the tan δ peak value.

If the tan δ peak temperature is more than 8° C., the polyurethane rubber becomes like a resin under a low temperature environment, and therefore slip-through of toner easily occurs under a low temperature environment and toner cleanability under a low temperature environment is deteriorated. The tan δ peak temperature can be preferably 5° C. or lower, more preferably 3° C. or lower, from the viewpoint of an enhancement in toner cleanability, for example. Herein, the lower limit of the tan δ peak temperature can be preferably −2° C. or higher, more preferably 0° C. or higher, from the viewpoint of the maintenance of toner cleanability under a high temperature environment.

On the other hand, if the tan δ peak value is more than 1.1, the rubber is highly vibrated at a higher temperature, and therefore slip-through of toner easily occurs under a high temperature environment and toner cleanability under a high temperature environment is deteriorated. The tan δ peak value can be preferably 1.0 or less, more preferably 0.9 or less, further preferably 0.8 or less, further more preferably 0.78 or less, still more preferably 0.75 or less, in particular from the viewpoint of an enhancement in toner cleanability under a high temperature environment.

In the blade member, the polyurethane rubber may have a NCO index in the range from 110 to 160. In such a case, ensuring of the strength and the degradation resistance of the blade body, and ensuring of toner cleanability under a low temperature environment are achieved in a well-balanced manner. The NCO index may be preferably 115 or more, more preferably 120 or more, further preferably 125 or more, further more preferably 130 or more, from the viewpoint of ensuring of the strength and the degradation resistance of the blade body, for example. The NCO index may be preferably 155 or less, more preferably 150 or less, further preferably 145 or less, from the viewpoints of ensuring toner cleanability under a low temperature environment, ease of molding, and the like. Herein, the NCO index of the polyurethane rubber can be calculated as the equivalent of an NCO group of a main agent relative to 100 equivalents of active hydrogen groups (OH group, amino group and the like) of a curing agent in a urethane material for use in formation of the blade body made of a polyurethane rubber.

Herein, the international rubber hardness degree, the tan δ peak temperature, the tan δ peak value and the NCO index of the polyurethane rubber can be adjusted within the above ranges by changes in the type and the number average molecular weight of the polyester polyol, the types and the ratio of the chain extender and the crosslinking agent, the mixing ratio of the main agent and the curing agent, and the like.

The blade member includes the film containing the hydrocarbon polymer as the main component. The "main component" refers to a component in a content of 50% by mass or more, among components forming the film. Herein, the film can include graphene, graphite and the like as an essential component for production, for example, as long as the effects of the present invention are achieved. The film may cover all of the blade body or only a part of the blade member as long as the film covers the surface of the sliding contact portion of the blade body with the counterpart member.

A covering portion of the blade body provided with the film may have an H1/H2 ratio of 2 or less, when the Martens hardness of the surface of the covering portion under a load of 0.1 mN is designated as H1, and the Martens hardness of the surface of the covering portion under a load of 1 mN is designated as H2. The H1/H2 ratio can be preferably 1.95 or less, more preferably 1.9 or less, further preferably 1.85 or less, further more preferably 1.8 or less, from the above viewpoint. In addition, the H1/H2 ratio can be preferably 1 or more, more preferably 1.5 or more, from the viewpoint of being advantageous in terms of a reduction in friction coefficient and ensuring of the wear resistance of the sliding contact portion, for example.

Herein, the H1 and the H2 can be measured using a microhardness tester ("FISHERSCOPE Hm2000LT" manufactured by Fischer Instruments K.K.) according to ISO 14577. The measurement conditions are as follows. A quadrangular pyramid Vickers indenter is used for the indenter of the microhardness tester. The load by the Vickers indenter in measurement of the H1 is set to 0.1 mN, and the load by the Vickers indenter in measurement of the H2 is set to 1 mN. The loads by the Vickers indenter are continuously changed from 0.1 to 100 mN, and the value of the load in each case is used. Each of the H1 and the H2 is the average of the Martens hardnesses measured at 3 points on the surface of the covering portion (the central portion in the longitudinal direction, the intermediate point between the central portion and the left end portion, and the intermediate point between the central portion and the right end portion).

The film can be configured to have an average of Raman scattering intensities of 100 to 1000 (a.u.) in the Raman shift range from 2000 to 3000 $cm^{-1}$ of the Raman spectrum measured using excited laser light of a wavelength of 532 nm and a laser intensity of 0.6 mW.

In such a case, a film including a hydrocarbon polymer as a main component and having a few graphene structures is easily formed, and therefore the effect of the film can be sufficiently achieved.

When the average of Raman scattering intensities of the film is 100 (a.u.) or more, it is ensured that the film has a configuration different from that of the polyurethane rubber forming the blade body. When the average of Raman scattering intensities of the film is 1000 (a.u.) or less, it is ensured that the film has a configuration different from that of a carbon film (poor in light permeability and black in color) formed by chemical vapor deposition using a hydrocarbon gas in the state of plasma generated with high-frequency plasma (RF plasma) and having many graphene structures, and is formed by a hydrocarbon polymer (flexible, and also high in light permeability) as a main component.

The average of Raman scattering intensities of the film can be preferably 200 (a.u.) or more, more preferably 250 (a.u.) or more, further preferably 300 (a.u.) or more, from the viewpoint that the friction reduction effect of the film is more sufficiently exerted, for example. The average of Raman scattering intensities of the film can be preferably 800 (a.u.) or less, more preferably 600 (a.u.) or less, further preferably 500 (a.u.) or less, from the viewpoints that, for example, a large number of C—H bonds are ensured to make the film flexible, resulting in an enhancement in followability to the counterpart member to easily suppress slip-through of toner, and a high light permeability useful for examination using light is achieved.

The thickness of the film can be preferably 5 nm or more, more preferably 10 nm or more, further preferably 30 nm or more, from the viewpoints that the friction reduction effect is easily exerted and initial curling up is easily suppressed. In addition, the thickness of the film can be preferably 230 nm or less, more preferably 200 nm or less, further preferably 150 nm or less, further more preferably 100 nm or less, from the viewpoints that the hardness is decreased and the toner cleaning failure due to slip-through of toner is easily suppressed. Herein, the thickness of the film corresponds to the average of the film thicknesses measured by ESCA (X-ray photoelectron spectroscopy) at 3 points (the central portion in the longitudinal direction, the intermediate point between the central portion and the left end portion, and the intermediate point between the central portion and the right end portion).

The dynamic friction coefficient of the film can be preferably 1.5 or less, more preferably 1.3 or less, further preferably 1 or less, from the viewpoint that initial curling up is effectively suppressed.

The film can be formed at least on the surface of the sliding contact portion by chemical vapor deposition (CVD) using a hydrocarbon gas in the state of plasma generated with microwaves.

When the hydrocarbon gas in the state of plasma generated with microwaves is used, a bias potential can be hardly generated to allow a positively-charged particle to mildly collide with the blade body, resulting in formation of a film made of a hydrocarbon polymer on the surface of the sliding contact portion without cleavage of any C—H bond. That is, a film formed is hardly graphitized. Moreover, a thin film in the order of nanometers is also easily formed. Therefore, in such a case, the film is easily high in flexibility and slip-through of toner is easily suppressed.

The method for producing the blade member includes a blade body preparation step of preparing a blade body made of a polyurethane rubber using diphenylmethane diisocyanate and a polyester polyol as main raw materials and having an international rubber hardness degree of 65 to 85 IRHD, a tan δ peak temperature of 8° C. or lower, and a tan δ peak value of 1.1 or less, and a film formation step of at least forming a film containing a hydrocarbon polymer as a main component on a surface of a portion of the blade body, the portion being a sliding contact portion for sliding contact with the mating member, by chemical vapor deposition using a hydrocarbon gas in the form of plasma generated with microwaves.

The method for producing a blade member includes the respective steps. Therefore, the blade member can be suitably produced.

In the blade body preparation step, the blade body made of a polyurethane rubber can be prepared by, for example, injecting a urethane composition into the cavity of a mold, and reacting and curing it under predetermined conditions. Here, the reaction temperature can be about 110 to 150° C., and the heating time can be about 3 minutes to 20 minutes. In addition, the blade body molded can be if necessary cut to a predetermined size, then washed with a hydrocarbon solvent, and dried by air blowing or the like. Thus, the blade body can be prepared.

The urethane composition can be prepared as follows. A main agent including a urethane prepolymer obtained by a reaction of diphenylmethane diisocyanate with a polyester polyol, and a curing agent including a polyester polyol, a chain extender, a crosslinking agent, a catalyst and the like are prepared. Next, the main agent and the curing agent are mixed to prepare the urethane composition. As described above, the international rubber hardness degree, the tan δ peak temperature, the tan δ peak value and the NCO index of the polyurethane rubber can be adjusted within the above ranges by changes in the type and the number average molecular weight of the polyester polyol, the types and the ratio of the chain extender and the crosslinking agent, the mixing ratio of the main agent and the curing agent, and the like.

The film formation step can be suitably performed by, for example, the following procedure. The blade body is placed on a support stand in a chamber of a microwave plasma CVD device optionally via a holding member. Then, the gas in the chamber is discharged, and the pressure in the chamber is reduced. Then, a carrier gas, and a hydrocarbon gas as a raw material gas are fed into the chamber. The types of the gases are not particularly limited as long as the film including a hydrocarbon polymer as a main component can be formed. For the carrier gas, a noble gas such as helium (He), neon (Ne), argon (Ar), krypton (Kr) or xenon (Xe), or a hydrogen gas can be applied singly or as a mixture, for example. For the hydrocarbon gas, a toluene gas, a benzene gas, a methane gas, an acetylene gas or the like can be applied singly or as a mixture. The volume percent of the raw material gas can be about 0.01 to 100% by volume, and the pressure in the chamber can be about 0.01 to 130 Pa. Then, microwaves are supplied to the chamber to convert the hydrocarbon gas and if necessary the carrier gas in the chamber to those in the state of plasma with the intense electric field of microwaves. The frequency of microwaves can be, for example, 8.35 GHz, 2.45 GHz, 1.98 GHz, 915 MHz or the like. Then, the hydrocarbon gas in the state of plasma generated with microwaves is allowed to act on the surface of the blade body, to form the film including a hydrocarbon polymer as a main component at least on the surface of the sliding contact portion. The time for such a film formation treatment can be about 0.5 seconds to 30 minutes.

In the method for producing the blade member, the blade body preparation step and the film formation step can be modified as follows. That is, the blade body preparation step can include a procedure in which the blade body is washed with a hydrocarbon solvent and the hydrocarbon solvent is still remained on the blade body, and the film formation step can include a procedure in which a hydrocarbon gas generated by gasifying the hydrocarbon solvent on the blade body is converted to the state of plasma with microwaves.

In this case, the hydrocarbon gas generated by gasifying the hydrocarbon solvent attached to the blade body due to the washing is used as the raw material gas and is converted to that in the state of plasma with microwaves, and therefore a hydrocarbon gas in the state of gas is decreased or is not used. Moreover, when the blade member is washed, drying after the washing is not required as well. Therefore, in this case, there is the following advantage: a process for producing the blade member can be simplified. Here, other procedures are the same as those described above, and the description of the procedures is omitted.

The hydrocarbon solvent can be gasified by means of heating to the temperature of the film formation treatment by a microwave plasma CVD device, for example. In such a case, heating is not required only for gasifying the hydrocarbon solvent, and therefore there are the following advantages: the production process can be further simplified, energy saving is achieved, and the like.

Examples of the hydrocarbon solvent can include normal decane, normal undecane and isododecane. These can be used singly or in combinations of two or more.

The boiling point of the hydrocarbon solvent can be preferably 200° C. or lower. In such a case, the hydrocarbon gas can be generated at a relatively low temperature, resulting in stable film formation. The boiling point of the hydrocarbon solvent can be more preferably 190° C. or lower, further preferably 180° C. or lower, in terms of the gasifying rate in the film formation treatment, and the like. The boiling point of the hydrocarbon solvent can be preferably 130° C. or higher, more preferably 140° C. or higher, further preferably 150° C. or higher, in terms of safety, particularly inflammability and the like.

Specifically, the cleaning blade can be configured to include the blade member, and a holding member that holds the blade member. The holding member can be integrated with the blade member by embedding the front end portion of the holding member in the rear end portion of the blade body, or bonding the holding member to the rear end portion of the blade body by an adhesive or the like afterward.

Herein, the respective configurations described above can be combined in order to exert the respective effects described above, and the like, as necessary.

EXAMPLES

Hereinafter, blade members and production methods of the same as well as cleaning blades in Examples are described with reference to the drawings. The same member is described using the same reference number.

Example 1

Figure 2:
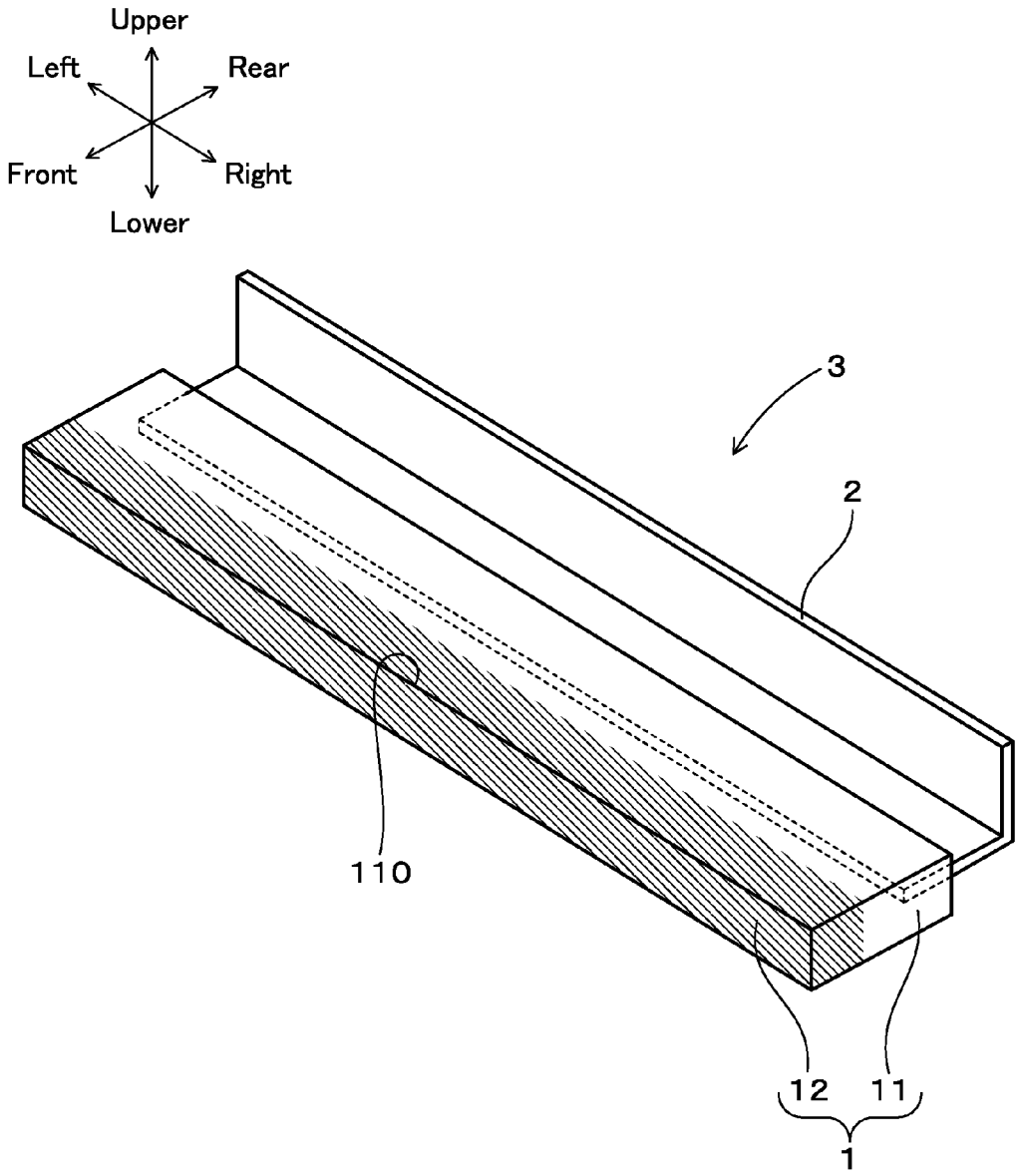
FIG. 2 is a perspective view schematically illustrating the blade member of Example 1 and the cleaning blade of Example 2.

A blade member of Example 1 is described with reference to FIG. 1 and FIG. 2. As illustrated in FIG. 1 and FIG. 2, a blade member 1 of the present Example is used for removal of residual toner 5 remaining on a surface of a counterpart member 4 in an image forming device employing an electrophotographic system, by sliding contact with the counterpart member 4.

In the present Example, specifically, the counterpart member 4 is a photoreceptor drum in the image forming device of an electrophotographic system. The blade member 1 serves to scrape off and remove residual toner (including not only toner but also a toner external additive) remaining on a surface of the photoreceptor drum after fixing of a toner image on paper, by sliding contact with the photoreceptor drum.

The blade member 1 has a blade body 11 made of a polyurethane rubber using diphenylmethane diisocyanate and a polyester polyol as main raw materials, and a film 12 that covers at least a surface of a sliding contact portion of the blade body 11 to contact with the counterpart member 4. The polyurethane rubber has an international rubber hardness degree of 65 to 85 IRHD, a tan δ peak temperature of 8° C. or lower and a tan δ peak value of 1.1 or less, and the film 12 contains a hydrocarbon polymer as a main component. The covering portion of the blade body provided with the film 12 has an H1/H2 ratio of 2 or less, when the Martens hardness of the surface of the covering portion under a load of 0.1 mN is designated as H1, and the Martens hardness of the surface of the covering portion under a load of 1 mN is designated as H2.

In the present Example, specifically, the blade body 11 is formed in the shape of a substantially long plate. Herein, the thickness of a part from a middle portion to a rear end portion of the blade body 11 may be, but not illustrated, larger than the thickness of a part from the middle portion to a front end portion in the longitudinal direction. Specifically, the film 12 is formed on the front half region of each of the upper, lower, left and right surfaces as well as the front surface of the blade body 11, as illustrated in FIG. 2. The film 12 covers an edge portion 110 of the blade body 11. The edge portion 110 is contained in the sliding contact portion of the blade body 11.

In the blade member 1 of the present Example, the film 12 has an average of Raman scattering intensities of 100 to 1000 (a.u.) in the Raman shift range from 2000 to 3000 $cm^{-1}$ of the Raman spectrum measured using excited laser light of a wavelength of 532 nm and a laser intensity of 0.6 mW. The film 12 is formed on the surface area of the blade body 11 including the sliding contact portion by chemical vapor deposition using a hydrocarbon gas in the state of plasma generated with microwaves. In the present Example, the thickness of the film 12 is in the range from 5 to 230 nm.

Example 2

A cleaning blade of Example 2 is described with reference to FIG. 1 and FIG. 2. As illustrated in FIG. 1 and FIG. 2, a cleaning blade 3 of the present Example includes the blade member 1 of Example 1. In the present Example, specifically, the cleaning blade 3 has the blade member 1 and a holding member 2.

The holding member 2 is metallic, and has a long plate shape having an L-shaped cross section. A front end portion of the holding member 2 is embedded in the rear end portion of the blade body 11. The blade member 1 and the holding member 2 are thus integrated. Herein, they can also be integrated by bonding of the holding member 2 to the blade body 11 afterward. The holding member 2 is secured to a cleaning device not illustrated to mount the cleaning blade 3 to the photoreceptor drum in a sliding contact manner. Then, as the photoreceptor drum is rotated, the edge portion of the blade member 1 is brought into sliding contact with the surface of the photoreceptor drum to thereby scrape off and remove residual toner attached to the surface of the photoreceptor drum.

Example 3

A method for producing a blade member of Example 3 is described. The method for producing a blade member of the present Example is a method that can suitably produce the blade member of Example 1. The method for producing a blade member of the present Example includes a blade body preparation step of preparing a blade body made of a polyurethane rubber using diphenylmethane diisocyanate and a polyester polyol as main raw materials and having an international rubber hardness degree of 65 to 85 IRHD, a tan δ peak temperature of 8° C. or lower and a tan δ peak value of 1.1 or less, and a film formation step of forming a film containing a hydrocarbon polymer as a main component on the surface of a sliding contact portion of the blade body to contact with a counterpart member, by chemical vapor deposition using a hydrocarbon gas in the state of plasma generated with microwaves.

In the present Example, specifically, the film formation step includes a procedure in which a hydrocarbon gas fed in the state of gas from a hydrocarbon gas source is converted to that in the state of plasma with the microwaves.

Example 4

A method for producing a blade member of Example 4 is described. The method for producing the blade member of the present Example is different from the method for producing the blade member of Example 3 in the following respects. That is, in the present Example, the blade body preparation step includes a procedure in which the blade body is washed with a hydrocarbon solvent and the hydrocarbon solvent is still remained on the blade body. In addition, the film formation step does not include a procedure in which a hydrocarbon gas in the state of gas is fed from a hydrocarbon gas source, but includes a procedure in which a hydrocarbon gas generated by gasifying the hydrocarbon solvent attached to the blade body due to the washing is converted to that in the state of plasma with microwaves. Other steps are the same as those of the method for producing the blade member of Example 3.

Hereinafter, the present invention is more specifically described with reference to Experimental Example.

Experimental Example 1

Preparation of Materials

The following materials were prepared as the materials of the urethane composition for use in formation of the blade member.

<Polyol>

Polybutylene adipate (PBA, number average molecular weight Mn=500) (synthetic product)

In the present Example, synthesis was made by a polycondensation reaction of 1,4-butanediol with adipic acid.

Polybutylene adipate (PBA, number average molecular weight Mn=1000) ("Nippolan 4009" manufactured by Nippon Polyurethane Industry Co., Ltd.)

Polybutylene adipate (PBA, number average molecular weight Mn=2000) ("Nippolan 4010" manufactured by Nippon Polyurethane Industry Co., Ltd.)

Polybutylene adipate (PBA, number average molecular weight Mn=3000) (synthetic product)

In the present Example, synthesis was made by a polycondensation reaction of 1,4-butanediol with adipic acid.

Polybutylene adipate (PBA, number average molecular weight Mn=3500) (synthetic product)

In the present Example, synthesis was made by a polycondensation reaction of 1,4-butanediol with adipic acid.

Polyethylene adipate (PEA, number average molecular weight Mn=2000) ("Nippolan 4040" manufactured by Nippon Polyurethane Industry Co., Ltd.)

Copolymer of ethylene adipate and butylene adipate (EA/BA, number average molecular weight Mn=2000) ("Nippolan 4042" manufactured by Nippon Polyurethane Industry Co., Ltd.)

Polyhexylene adipate (PHA, number average molecular weight Mn=2000) ("Nippolan 4073" manufactured by Nippon Polyurethane Industry Co., Ltd.)

Polytetramethylene glycol (PTMG, number average molecular weight Mn=2000) ("PTMG 2000" manufactured by Mitsubishi Chemical Corporation)

<Polyisocyanate>

4,4'-Diphenylmethane diisocyanate (MDI) ("Millionate MT" manufactured by Nippon Polyurethane Industry Co., Ltd.)

Tolylene diisocyanate (TDI) ("Cosmonate T100" produced by Mitsui Chemicals, Inc.)

<Chain Extender>

1,4-Butanediol (1,4BD) (manufactured by Mitsubishi Chemical Corporation)

Ethylene glycol (EG) (manufactured by Mitsubishi Chemical Corporation)

1,6-Hexanediol (1,6HD) (manufactured by Kanto Chemical Co., Inc.)

<Crosslinking Agent>

Trimethylolpropane (TMP) (manufactured by Mitsubishi Gas Chemical Company, Inc.)

<Catalyst>

Thermosensitive catalyst ("DABCO TMR-3" manufactured by Air Products and Chemicals, Inc.)

Triethylenediamine ("TEDA" manufactured by Tosoh Corporation)

—Preparation of Urethane Composition—

As shown in Table 1 to Table 3 below, a predetermined amount of a predetermined polyol and a predetermined amount of a predetermined polyisocyanate subjected to defoaming in vacuum at 80° C. for 1 hour were mixed, and reacted under a nitrogen atmosphere at 80° C. for 3 hours to prepare each main agent so that the NCO % was 16.5%.

In addition, as shown in Table 1 to Table 3 below, a predetermined amount of a predetermined polyol, a mixture of a predetermined chain extender and a predetermined crosslinking agent, and the above thermosensitive catalyst and triethylenediamine as the catalysts were mixed under a nitrogen atmosphere at 80° C. for 1 hour, to thereby prepare each curing agent so that the hydroxyl value was 150. Herein, the mixture of a chain extender and a crosslinking agent was obtained by mixing the chain extender and the crosslinking agent in a predetermined mass ratio shown in Table 1 to Table 3. In addition, both the compounded amounts of the respective catalysts were 0.005% by mass when the total mass of the predetermined polyol and the mixture of the chain extender and the crosslinking agent was 100% by mass.

Next, each main agent liquid and each curing agent liquid prepared above were mixed in a vacuum atmosphere at 60° C. for 1 minute in a mixing ratio so that a predetermined NCO index was obtained, and subjected to sufficient defoaming. Thus, each urethane composition was prepared.

—Production of Cleaning Blade Sample—

Each urethane composition prepared was injected into the cavity of a mold in which a holding member was placed, and heated and cured at 130° C. for 10 minutes. After the curing, the resultant was taken out from the mold, and cut to a predetermined size. Thus, each molded body with a blade body and the holding member integrated was produced.

Next, the surface of the blade body of each molded body (see FIG. 2) was subjected to a microwave plasma CVD treatment in which each film containing a hydrocarbon polymer as a main component was formed by chemical vapor deposition using a hydrocarbon gas in the state of plasma generated with microwaves by using a microwave plasma CVD device. Thus, each of cleaning blade samples 1 to 20 and samples 23 to 25 was produced.

In the microwave plasma CVD treatment, a toluene gas as a carbonizing agent gas fed in the state of gas from a hydrocarbon gas source was used as a raw material gas, and an argon gas was used as a carrier gas. In addition, after the raw material gas and the carrier gas were introduced into the chamber of the microwave plasma CVD device to adjust the pressure to 50 Pa or less, microwaves having a frequency of 2.45 GHz were transmitted into the chamber to thereby convert the raw material gas and the carrier gas to those in the state of plasma. In the present Experimental Example, the output power of the microwaves was 2.0 kW, and the treatment time of film formation was appropriately changed in the range from 15 seconds to 30 minutes in order to modulate the thickness of each film.

A molded body not subjected to the microwave plasma CVD treatment was used as comparative cleaning blade sample 21. A film was formed by not the microwave plasma CVD treatment but an RF plasma CVD treatment, to thereby produce cleaning blade sample 22. The formed film is a carbon film having a thickness of 50 nm. In the RF plasma CVD treatment, the output power of RF was 600 W, the frequency was 13.56 MHz, and the treatment time of film formation was 30 minutes.

—Measurement of International Rubber Hardness Degree of Polyurethane Rubber—

The international rubber hardness degree of a sample taken from a portion of the blade body, not having any film, was measured by the international rubber hardness degree test method, M method under measurement conditions of 25° C. and 50% RH by using a WALLACE micro-hardness tester manufactured by H.W. WALLACE according to JIS K 6253.

—Measurement of Tan δ Peak Temperature and Tan δ Peak Value of Polyurethane Rubber—

A sample (1.6 mm×1.6 mm×30 mm) taken from a portion of the blade body, not having any film, was secured on a dynamic viscoelasticity measurement apparatus (DVE Rheospectoler manufactured by Rheology Co., Ltd.) so that the measurement length was 20 mm, and a sine wave strain of a displacement amplitude of ±10 μm and a frequency of 10 Hz was applied thereto and the tan δ (loss tangent) in the range from −20° C. to 50° C. was measured every 1° C. at a rate of temperature rise of 3° C./min. The temperature at which the resulting tan δ value was maximum (peak) was determined as the tan δ peak temperature, and the maximum tan δ value was determined as the tan δ peak value.

—Raman Spectroscopic Analysis of Film and Blade Body—

The film of the cleaning blade of each of sample 3 and sample 22, and the blade body (polyurethane rubber) of the cleaning blade of sample 3 were subjected to analysis by the Raman spectrometric method. For the analysis, a laser Raman spectrophotometer ("NRS-5100" manufactured by JASCO Corporation) was used. The analysis conditions were as follows:

excitation wavelength: 532 nm, laser intensity: 0.6 mW, slit width: 10×1000 μm, aperture ϕ: 4000 μm, object lens: MPLFLN 100×, exposure time: 20 seconds, cumulative number: 10, center frequency: 2172.71 $cm^{-1}$ —Measurement of Thickness of Film—

The thickness of each film was measured by ESCA (X-ray photoelectron spectroscopy) at 3 points (the central portion in the longitudinal direction, the intermediate point between the central portion and the left end portion, and the intermediate point between the central portion and the right end portion), and the average was defined as the thickness of each film.

—Measurement of Dynamic Friction Coefficient of Film—

Figure 4:
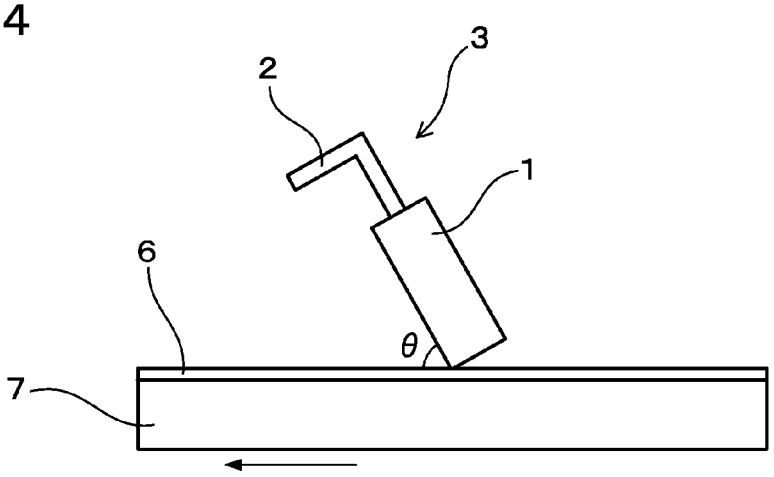
FIG. 4 is an explanatory view for illustrating a method for measuring the dynamic friction coefficient of the film in the sample produced in Experimental Example.

As illustrated in FIG. 4, a blade member 1 was pressed (pressing angle θ: 60°, pressing force: 1 N/cm) on a metallic plate member 7 with a PET sheet 6 having a thickness of 150 μm disposed on the surface. The plate member 7 was moved at a rate of 2.5 mm/sec. in the direction of the arrow in the Figure, and the dynamic friction coefficient μk of a film 12 was measured. With respect to sample 21 without the film 12 formed, the dynamic friction coefficient of a blade body 11 was measured.

—Measurement of H1/H2 Ratio—

The H1 and the H2 of each cleaning blade sample were measured by the above method, and the H1/H2 ratio was calculated.

—Evaluation of Durability—

Each cleaning blade sample was incorporated into a cartridge of a commercially available laser printer ("Laser Jet P3015dn" manufactured by Hewlett-Packard Japan, Ltd.), and an image (image: lateral image having a density of 2%) was output for 12000 sheets in A4 size under an environment of 23° C.×50% RH. After printing for 12000 sheets, black, halftone and white images were printed and checked. A case where the images did not have defects such as streaks and stains after printing for 12000 sheets was rated as "A" where the blade member was excellent in durability. A case where the images slightly had streaks after printing for 12000 sheets, but were acceptable was rated as "B" where the blade member was good in durability. A case where the images had defects such as streaks and stains after printing for 12000 sheets was rated as "C" where the blade member was poor in durability.

—Evaluation of Initial Curling Up—

Each cleaning blade sample was incorporated into a cartridge of the commercially available laser printer from which toner was extracted, and a photoreceptor drum was rotated under an environment of 32° C.×85% RH for 30 seconds. A case where curling up of the blade member did not occur for 30 seconds was rated as "A" where the blade member was excellent in initial curling-up resistance. A case where the curling up occurred after a lapse of 15 seconds to 30 seconds was rated as "B" where the blade member was good in initial curling-up resistance. The reason for such rating is because the toner in the cartridge usually tends to serve as a lubricant to hardly cause initial curling up to occur. A case where curling up of the blade member occurred after a lapse of 15 seconds or less was rated as "C" where the blade member was poor in initial curling-up resistance.

—Evaluation of Toner Cleanability—

Each cleaning blade sample was incorporated into the cartridge of the commercially available laser printer, and an image (image: lateral image having a density of 2%) was output for 1000 sheets in A4 size under an environment of 25° C.×50% RH. Thereafter, the image was left to stand under environments of 0° C. and 5° C. for 3 hours, and black, halftone and white images were then printed and checked. A case where the images did not have defects such as streaks and stains even after being left to stand under both environments of 0° C. and 5° C. was rated as "A" where the blade member was excellent in toner cleanability under a low temperature environment. A case where the images did not have the defects in a test after being left to stand under an environment of 5° C., but had the defects in a test after being left to stand under an environment of 0° C. was rated as "B" where the blade member was good in toner cleanability under a low temperature environment. A case where the images had the defects in a test after being left to stand under both environments of 5° C. and 0° C. was rated as "C" where the blade member was poor in toner cleanability under a low temperature environment.

Similarly, each cleaning blade sample was incorporated into the cartridge of the commercially available laser printer and an image (image: lateral image having a density of 2%) was output for 1000 sheets in A4 size under an environment of 25° C.×50% RH. Thereafter, the image was left to stand under environments of 35° C. and 40° C. for 3 hours, and black, halftone and white images were then printed and checked. A case where the images did not have defects such as streaks and stains even after being left to stand under both environments of 35° C. and 40° C. was rated as "A" where the blade member was excellent in toner cleanability under a high temperature environment. A case where the images did not have the defects in a test after being left to stand under an environment of 35° C., but had the defects in a test after being left to stand under an environment of 40° C. was rated as "B" where the blade member was good in toner cleanability under a high temperature environment. A case where the images had the defects in a test after being left to stand under both environments of 35° C. and 40° C. was rated as "C" where the blade member was poor in toner cleanability under a high temperature environment.

Figure 3:
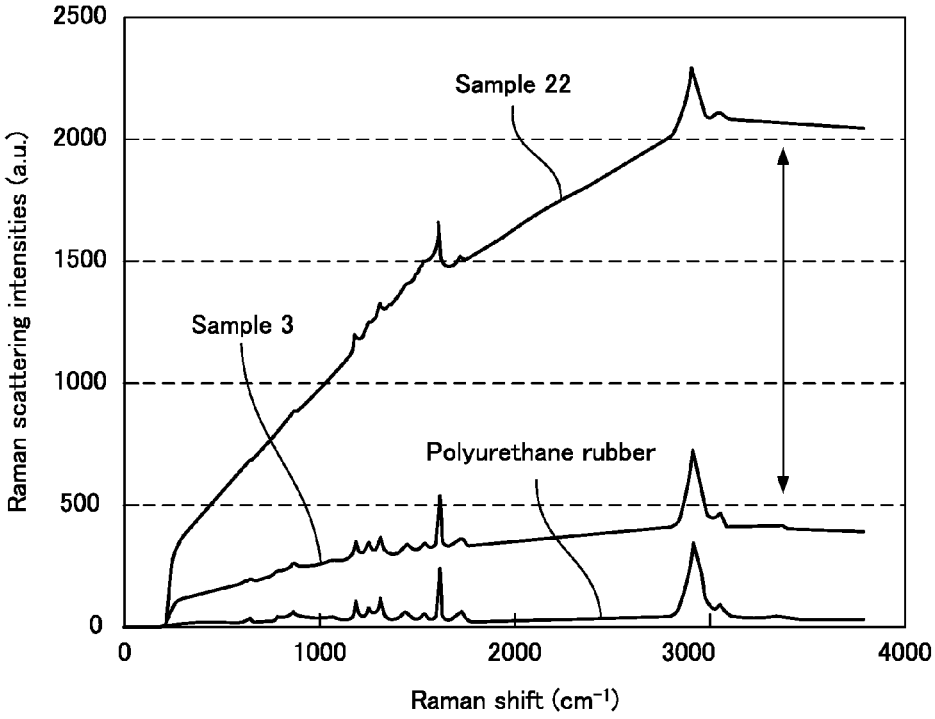
FIG. 3 shows Raman spectra of a film and a blade body (polyurethane rubber) in a sample produced in Experimental Example.

Table 1 to Table 3 show the detail configuration, the measurement results, and the evaluation results of each cleaning blade sample. In addition, FIG. 3 illustrates the Raman spectra of the film and the blade body (polyurethane rubber) of each of sample 3 and sample 22.

TABLE 1

| | | | Sample | | | | |
|---|---|---|---|---|---|---|---|
| | | | 1 | 2 | 3 | 4 | 5 |
| Blade body | Polyurethane rubber | Type of polyisocyanate | MDI | MDI | MDI | MDI | MDI |
| | | Type of polyol | PEA | PEA/BA | PBA | PBA | PBA |
| | | Number average molecular weight of polyol: Mn | 2000 | 2000 | 2000 | 2000 | 2000 |
| | | Type of chain extender | 1,4BD | 1,4BD | 1,4BD | 1,4BD | 1,4BD |
| | | Type of crosslinking agent | TMP | TMP | TMP | TMP | TMP |
| | | Mass ratio of chain extender/crosslinking agent | 60/40 | 60/40 | 60/40 | 60/40 | 60/40 |
| | | International Rubber Hardness Degree (IRHD) | 65 | 70 | 74 | 74 | 74 |
| | | tanδ peak temperature | 8° C. | 5° C. | 3° C. | 3° C. | 2° C. |
| | | tanδ peak value | 0.8 | 0.78 | 0.75 | 0.75 | 0.74 |
| | | NCO index | 110 | 115 | 140 | 140 | 140 |
| Film | Main component of film | | Hydrocarbon polymer | Hydrocarbon polymer | Hydrocarbon polymer | Hydrocarbon polymer | Hydrocarbon polymer |
| | Thickness of film (nm) | | 50 | 50 | 100 | 50 | 50 |
| | Dynamic friction coefficient: μk | | 0.8 | 0.8 | 0.8 | 0.8 | 0.8 |
| | H1/H2 ratio | | 1.8 | 1.8 | 1.8 | 1.8 | 1.8 |
| Evaluation | Durability | | B | B | A | A | B |
| | Initial curling up | | A | A | A | A | A |
| | Toner cleanability | | | | | | |
| | Under low temperature environment | | B | A | A | A | A |
| | Under high temperature environment | | A | A | A | A | A |

| | | | Sample | | | | |
|---|---|---|---|---|---|---|---|
| | | | 6 | 7 | 8 | 9 | 10 |
| Blade body | Polyurethane rubber | Type of polyisocyanate | MDI | MDI | MDI | MDI | MDI |
| | | Type of polyol | PBA | PBA | PBA | PBA | PBA |
| | | Number average molecular weight of polyol: Mn | 1000 | 3000 | 3500 | 2000 | 2000 |
| | | Type of chain extender | 1,4BD | 1,4BD | 1,4BD | EG | 1,6HD |
| | | Type of crosslinking agent | TMP | TMP | TMP | TMP | TMP |
| | | Mass ratio of chain extender/crosslinking agent | 60/40 | 60/40 | 60/40 | 60/40 | 60/40 |
| | | International Rubber Hardness Degree (IRHD) | 76 | 74 | 74 | 76 | 73 |
| | | tanδ peak temperature | 5° C. | 2° C. | 2° C. | 6° C. | 2° C. |
| | | tanδ peak value | 0.79 | 0.71 | 0.72 | 0.78 | 0.75 |
| | | NCO index | 140 | 140 | 140 | 140 | 140 |
| Film | Main component of film | | Hydrocarbon polymer | Hydrocarbon polymer | Hydrocarbon polymer | Hydrocarbon polymer | Hydrocarbon polymer |
| | Thickness of film (nm) | | 50 | 50 | 50 | 50 | 50 |
| | Dynamic friction coefficient: μk | | 0.8 | 0.8 | 0.8 | 0.8 | 0.8 |
| | H1/H2 ratio | | 1.8 | 1.8 | 1.8 | 1.8 | 1.8 |
| Evaluation | Durability | | B | A | A | B | A |
| | Initial curling up | | A | A | A | A | A |
| | Toner cleanability | | | | | | |
| | Under low temperature environment | | A | A | A | A | A |
| | Under high temperature environment | | A | A | A | A | A |

TABLE 2

| | | | Sample | | | | |
|---|---|---|---|---|---|---|---|
| | | | 11 | 12 | 13 | 14 | 15 |
| Blade body | Polyurethane rubber | Type of polyisocyanate | MDI | MDI | MDI | MDI | MDI |
| | | Type of polyol | PBA | PBA | PBA | PBA | PBA |
| | | Number average molecular weight of polyol: Mn | 2000 | 2000 | 2000 | 2000 | 2000 |
| | | Type of chain extender | 1,4BD | 1,4BD | 1,4BD | 1,4BD | 1,4BD |
| | | Type of crosslinking agent | TMP | TMP | TMP | TMP | TMP |

TABLE 2-continued

| | | | | | | | |
|---|---|---|---|---|---|---|---|
| | | Mass ratio of chain extender/crosslinking agent | 70/30 | 50/50 | 60/40 | 60/40 | 60/40 |
| | | International Rubber Hardness Degree (IRHD) | 80 | 75 | 74 | 74 | 76 |
| | | tanδ peak temperature | −2° C. | 5° C. | 3° C. | 3° C. | 3° C. |
| | | tanδ peak value | 0.69 | 0.8 | 0.75 | 0.75 | 0.75 |
| | | NCO index | 140 | 140 | 140 | 140 | 140 |
| Film | Main component of film | | Hydrocarbon polymer | Hydrocarbon polymer | Hydrocarbon polymer | Hydrocarbon polymer | Hydrocarbon polymer |
| | Thickness of film (nm) | | 50 | 50 | 5 | 10 | 150 |
| | Dynamic friction coefficient: μk | | 0.8 | 0.8 | 2.2 | 1.5 | 0.7 |
| | H1/H2 ratio | | 1.8 | 1.8 | 1.8 | 1.8 | 1.8 |
| Evaluation | Durability | | A | A | A | A | A |
| | Initial curling up | | A | A | B | A | A |
| | Toner cleanability | | | | | | |
| | Under low temperature environment | | A | B | A | A | A |
| | Under high temperature environment | | B | A | A | A | A |

| | | | Sample | | | | |
|---|---|---|---|---|---|---|---|
| | | | 16 | 17 | 18 | 19 | 20 |
| Blade body | Polyurethane rubber | Type of polyisocyanate | MDI | TDI | MDI | MDI | MDI |
| | | Type of polyol | PBA | PBA | PTMG | PBA | PBA |
| | | Number average molecular weight of polyol: Mn | 2000 | 2000 | 2000 | 500 | 2000 |
| | | Type of chain extender | 1,4BD | 1,4BD | 1,4BD | 1,4BD | 1,4BD |
| | | Type of crosslinking agent | TMP | TMP | TMP | TMP | TMP |
| | | Mass ratio of chain extender/crosslinking agent | 60/40 | 60/40 | 60/40 | 60/40 | 80/20 |
| | | International Rubber Hardness Degree (IRHD) | 74 | 63 | 72 | 77 | 86 |
| | | tanδ peak temperature | 3° C. | 7° C. | −12° C. | 9° C. | −3° C. |
| | | tanδ peak value | 0.75 | 0.86 | 0.41 | 0.8 | 0.64 |
| | | NCO index | 140 | 120 | 140 | 140 | 140 |
| Film | Main component of film | | Hydrocarbon polymer | Hydrocarbon polymer | Hydrocarbon polymer | Hydrocarbon polymer | Hydrocarbon polymer |
| | Thickness of film (nm) | | 230 | 50 | 50 | 50 | 50 |
| | Dynamic friction coefficient: μk | | 0.6 | 0.8 | 1 | 0.8 | 0.8 |
| | H1/H2 ratio | | 1.8 | 1.8 | 1.8 | 1.8 | 1.8 |
| Evaluation | Durability | | A | C | C | C | A |
| | Initial curling up | | A | A | A | A | A |
| | Toner cleanability | | | | | | |
| | Under low temperature environment | | B | C | A | C | C |
| | Under high temperature environment | | A | C | A | A | C |

TABLE 3

| | | | Sample | | | | |
|---|---|---|---|---|---|---|---|
| | | | 21 | 22 | 23 | 24 | 25 |
| Blade body | Polyurethane rubber | Type of polyisocyanate | MDI | MDI | MDI | MDI | MDI |
| | | Type of polyol | PBA | PBA | PBA | PBA | PBA |
| | | Number average molecular weight of polyol: Mn | 2000 | 2000 | 2000 | 2000 | 2000 |
| | | Type of chain extender | 1,4BD | 1,4BD | 1,4BD | 1,4BD | 1,4BD |
| | | Type of crosslinking agent | TMP | TMP | TMP | TMP | TMP |
| | | Mass ratio of chain extender/crosslinking agent | 60/40 | 60/40 | 50/50 | 60/40 | 60/40 |
| | | International Rubber Hardness Degree (IRHD) | 74 | 74 | 67 | 85 | 64 |
| | | tanδ peak temperature | 3° C. | 3° C. | −1° C. | 8° C. | −4° C. |
| | | tanδ peak value | 0.75 | 0.75 | 1.0 | 0.8 | 1.11 |
| | | NCO index | 140 | 140 | 113 | 160 | 110 |
| Film | Main component of film | | None | Carbon film | Hydrocarbon polymer | Hydrocarbon polymer | Hydrocarbon polymer |
| | Thickness of film (nm) | | None | 50 | 50 | 50 | 50 |
| | Dynamic friction coefficient: μk | | 3.5 | 1.2 | 0.8 | 0.8 | 0.8 |
| | H1/H2 ratio | | 1.8 | 2.2 | 1.8 | 1.8 | 1.8 |

TABLE 3-continued

| | | Sample | | | | |
|---|---|---|---|---|---|---|
| | | 21 | 22 | 23 | 24 | 25 |
| Evaluation | Durability | A | A | B | B | B |
| | Initial curling up | C | A | A | A | A |
| | Toner cleanability | | | | | |
| | Under low temperature environment | A | C | B | B | B |
| | Under high temperature environment | A | A | B | A | C |

The following can be seen from the above results.

The blade member and the cleaning blade of sample 17, in which TDI was used as the main raw material of the polyurethane rubber, cannot ensure a required wear resistance. In addition, the international rubber hardness degree of the polyurethane rubber was less than the lower limit defined in the present application, thereby resulting in also deterioration in wear resistance, a decrease in the contact force with the counterpart member to cause slip-through of toner to occur, and deteriorations in toner cleanability under both of a low temperature environment and a high temperature environment.

The blade member and the cleaning blade of sample 18, in which PTMG, being an ether polyol, was used as the main raw material of the polyurethane rubber, cannot ensure a required wear resistance.

The blade member and the cleaning blade of sample 19, in which the molecular weight of the polyol used was small, are poor in bonding property in the polymer, and cannot ensure a required wear resistance.

In the blade member and the cleaning blade of sample 20, the international rubber hardness degree of the polyurethane rubber was more than the upper limit defined in the present application, easily degrading the polyurethane rubber to easily cause slip-through of toner to occur, resulting in deterioration in toner cleanability.

The blade member and the cleaning blade of sample 21 do not have a film containing a hydrocarbon polymer as a main component on the surface of the blade body. Therefore, the dynamic friction coefficient of the polyurethane rubber was high to remarkably cause initial curling up to occur. Herein, since initial curling up occurred, the durability and the toner cleanability were evaluated by applying toner to a blade contact portion only at the initial stage.

The blade member and the cleaning blade of sample 22 have a carbon film formed on the surface of the blade member made of a polyurethane rubber. The carbon film was so high in film hardness as to result in deterioration in followability to the counterpart member, causing slip-through of toner to occur to deteriorate toner cleanability under a low temperature environment.

In the blade member and the cleaning blade of sample 25, the tan δ peak value of the polyurethane rubber was more than the upper limit defined in the present application to result in deterioration in toner cleanability under a high temperature environment.

On the contrary, in the blade member and the cleaning blade of each of sample 1 to sample 16, sample 23 and sample 24, the blade body is made of a polyurethane rubber using diphenylmethane diisocyanate and a polyester polyol as main raw materials. Therefore, the blade body is hardly worn due to sliding contact with the counterpart member, and has good durability. In addition, the polyurethane rubber forming the blade body has an international rubber hardness degree of 65 to 85 IRHD, a tan δ peak temperature of 8° C. or lower, and a tan δ peak value of 1.1 or less. Therefore, the material, the hardness and the viscoelastic property of the polyurethane rubber forming the blade body are suitable to suppress wear, a decrease in the contact force with the counterpart member, the occurrence of degradation, and a large variation in viscoelastic behavior, hardly causing slip-through of toner between the blade body and the counterpart member to occur over a wide operating temperature range from a low temperature to a high temperature.

In addition, the blade member and the cleaning blade of each of the samples has a film containing a hydrocarbon polymer as a main component, on the surface of a sliding contact portion of the blade body with the counterpart member. Therefore, the friction reduction effect of the film can result in a sufficient reduction in friction of the surface of the sliding contact portion, effectively suppressing initial curling up in a high temperature range. Moreover, the film is higher in flexibility than a carbon film such as a DLC film. Therefore, the blade member allows good followability to the counterpart member to be exhibited even in a low temperature range, and slip-through of toner hardly occurs.

It has been thus confirmed that the blade member and the cleaning blade of each of the samples have durability and allow initial curling up and slip-through of toner to be suppressed in a wide operating temperature range from a low temperature to a high temperature, to thereby have good toner cleanability.

The method for producing a blade member includes the blade body preparation step and the film formation step. Therefore, the blade member could be suitably produced.

In particular, as illustrated in FIG. 3, in comparison of the backgrounds in the Raman shift about 3000 to 4000 $cm^{-1}$ of the Raman spectrum measured using excited laser light of a wavelength of 532 nm and a laser intensity of 0.6 mW, peaks based on the blade member and the cleaning blade of sample 22 having the film formed by the RF plasma CVD treatment are much more observed than those based on the blade member and the cleaning blade of sample 3 having the film formed by the microwave plasma CVD treatment. The backgrounds in analysis by the Raman spectrometric method are based on fluorescence of C—C bonds (including a double bond and a triple bond). Therefore, as the number of C—C bonds is larger, a larger background is observed. Accordingly, it can be said that the film in sample 22 is a carbon film including a large number of C—C bonds. Moreover, a peak around a Raman shift of 1500 $cm^{-1}$ is based on a graphene structure. No peaks around a Raman shift of 1500 $cm^{-1}$ are observed in the film and the polyurethane rubber in sample 3. A peak around a Raman shift of 1500 $cm^{-1}$, however, is observed in the film in sample 22. It can be thus said that the film in sample 22 is a carbon film having many graphene structures and the film in sample 3 is a film having few graphene structures and including a hydrocarbon polymer as a main component.

In addition, it is ensured from the results in sample 3 that when the average of Raman scattering intensities of the film in the Raman shift range from 2000 to 3000 $cm^{-1}$ of the Raman spectrum is 100 (a.u.) or more, the film has a configuration different from that of the polyurethane rubber forming the blade body. Moreover, it is ensured that when the average of Raman scattering intensities of the film is 1000 (a.u.) or less, the film has a configuration different from that of a carbon film formed by chemical vapor deposition using a hydrocarbon gas in the state of plasma generated with RF plasma and having many graphene structures, and the main component is formed by a hydrocarbon polymer. The average of Raman scattering intensities of the film in sample 3 is 410 (a.u.), and samples 1 to 16 excluding sample 3, sample 23 and sample 24 have a similar film as in sample 3, and obtain similar results. It can be easily presumed from this that the average of Raman scattering intensities of each of the films in the samples is also in the range from 100 to 1000 (a.u.).

Although Examples of the present invention have been described above in detail, the present invention is not limited to these Examples, and various modifications can be made within the scope that does not impair the effects of the present invention.

The invention claimed is:

1. A blade member to be used for removal of residual toner remaining on a surface of a counterpart member in an image forming device employing an electrophotographic system, by sliding contact with the counterpart member, the blade member comprising:

a blade body made of a polyurethane rubber using diphenylmethane diisocyanate and a polyester polyol as main raw materials; and a film that covers at least a surface of a sliding contact portion of the blade body to contact with the counterpart member, wherein the polyurethane rubber has an international rubber hardness degree of 65 to 85 IRHD, a tan δ peak temperature of 8° C. or lower, and a tan δ peak value of 1.1 or less, the film contains a hydrocarbon polymer as a main component, and a covering portion of the blade body provided with the film has an H1/H2 ratio of 2 or less, when a Martens hardness of a surface of the covering portion under a load of 0.1 mN is designated as H1, and a Martens hardness of a surface of the covering portion under a load of 1 mN is designated as H2.

2. The blade member according to claim 1, wherein the film has an average of Raman scattering intensities of 100 to 1000 (a.u.) in a Raman shift range from 2000 to 3000 $cm^{-1}$ of a Raman spectrum measured using excited laser light of a wavelength of 532 nm and a laser intensity of 0.6 mW.

3. The blade member according to claim 1, wherein the film is formed at least on the surface of the sliding contact portion by chemical vapor deposition using a hydrocarbon gas in the state of plasma generated with microwaves.

4. The blade member according to claim 1, wherein the thickness of the film is in the range from 5 to 230 nm.

5. The blade member according to claim 4, wherein the polyurethane rubber has a NCO index in the range from 110 to 160.

6. A cleaning blade comprising the blade member according to claim 5.

7. The cleaning blade according to claim 6, wherein a number average molecular weight of the polyester polyol is in the range from 1000 to 3000.

8. The cleaning blade according to claim 6, wherein a chain extender is used as a raw material of the blade body, and the chain extender is polyols having a number average molecular weight of 300 or less.

9. The cleaning blade according to claim 6, wherein the polyurethane rubber has the international rubber hardness degree in the range from 69 to 81 IRHD.

10. The cleaning blade according to claim 6, wherein the polyurethane rubber has the tan δ peak temperature of 3° C. or lower.

11. The cleaning blade according to claim 6, wherein the polyurethane rubber has the tan δ peak value of 0.75 or less.

12. The cleaning blade according to claim 6, wherein the polyurethane rubber has the NCO index in the range from 130 to 145.

13. The cleaning blade according to claim 6, wherein the covering portion has the H1/H2 ratio of 1.8 or less.

14. The cleaning blade according to claim 6, wherein the thickness of the film is in the range from 30 to 100 nm.

15. The cleaning blade according to claim 6, wherein a number average molecular weight of the polyester polyol is in the range from 1000 to 3000, a chain extender is used as a raw material of the blade body, and the chain extender is polyols having a number average molecular weight of 300 or less, the polyurethane rubber has the international rubber hardness degree in the range from 69 to 81 IRHD, the tan δ peak temperature of 3° C. or lower, the tan δ peak value of 0.75 or less, and the NCO index in the range from 130 to 145, the covering portion has the H1/H2 ratio of 1.8 or less, and a thickness of the film is in the range from 30 to 100 nm.

16. The cleaning blade according to claim 15, wherein the film is formed at least on the surface of the sliding contact portion by chemical vapor deposition using a hydrocarbon gas in the state of plasma generated with microwaves.

17. The blade member according to claim 1, wherein the polyurethane rubber has a NCO index in the range from 110 to 160.

18. A cleaning blade comprising the blade member according to claim 1.

* * * * *